United States Patent [19]

Persson

[11] 4,226,066

[45] Oct. 7, 1980

[54] DOOR JAMB

[76] Inventor: Hans B. F. Persson, Gärdesgatan 8, 46400 Mellerud, Sweden

[21] Appl. No.: 946,459

[22] Filed: Sep. 27, 1978

[51] Int. Cl.[3] ..... E06B 1/04

[52] U.S. Cl. ..... 52/211; 52/213; 49/504

[58] Field of Search ..... 52/208, 211-217, 52/242; 49/504, 505

[56] References Cited

U.S. PATENT DOCUMENTS

| | | | |
|---|---|---|---|
| 1,005,249 | 10/1911 | Lunken | 52/213 |
| 1,864,577 | 6/1932 | Baum | 49/504 |
| 3,193,061 | 7/1965 | Downes | 52/242 |
| 3,256,668 | 6/1966 | Downes | 52/242 |

*Primary Examiner*—James L. Ridgill, Jr.

[57] ABSTRACT

A door jamb comprising, a first sheet metal section having a flat portion for attachment to a vertical face of an aperture in a wall and a pair of channel-shaped portions on either side of said flat portion, an inner flank of one channel-shaped portion being connected by said flat portion to an inner flank of the other channel-shaped portion, a second sheet metal section for accommodating one edge of a door leaf, said second sheet metal section including a pair of longitudinal flange portions, each of which is slidably displaceable transversely of a respective one of the outer flanks of said channel-shaped portions, and fasteners for fastening each of said longitudinal flange portions in a selected transverse position on the respective one of said outer flanks.

6 Claims, 4 Drawing Figures

DOOR JAMB

This invention relates to door jambs. More particularly, the invention relates to a door jamb of the type comprising a first sheet metal section having a flat portion for attachment to a vertical face of an aperture in a wall and a pair of longitudinal flange portions extending at right angles to said flat portion, a second sheet metal section for accommodating one edge of a door leaf, said second sheet metal section having a pair of longitudinal flange portions slidably displaceable transversely of the flange portions of said first sheet metal section, and, means for fastening each of the flange portions of said second sheet metal member in a selected transverse position on the corresponding flange portion of said first sheet metal member.

It is an object of the invention to provide a door jamb of this type which can be mounted flush with a wall and which has a flexibility sufficient to allow some adaption of the jamb to different wall thicknesses. It is also an object of the invention to provide a door jamb presenting a particularly neat and clean appearance, with a minimum of protruding edges.

The door jamb according to the invention is principally characterized in that said first sheet metal section includes a pair of channel-shaped portions, one flank of one channel-shaped portion being connected by said flat portion to one flank of the other channel-shaped portion, the other flanks of said channel-shaped portions constituting said flanges of the said first sheet metal section.

Other objects and features of the invention will appear from the following description.

Figure 1:
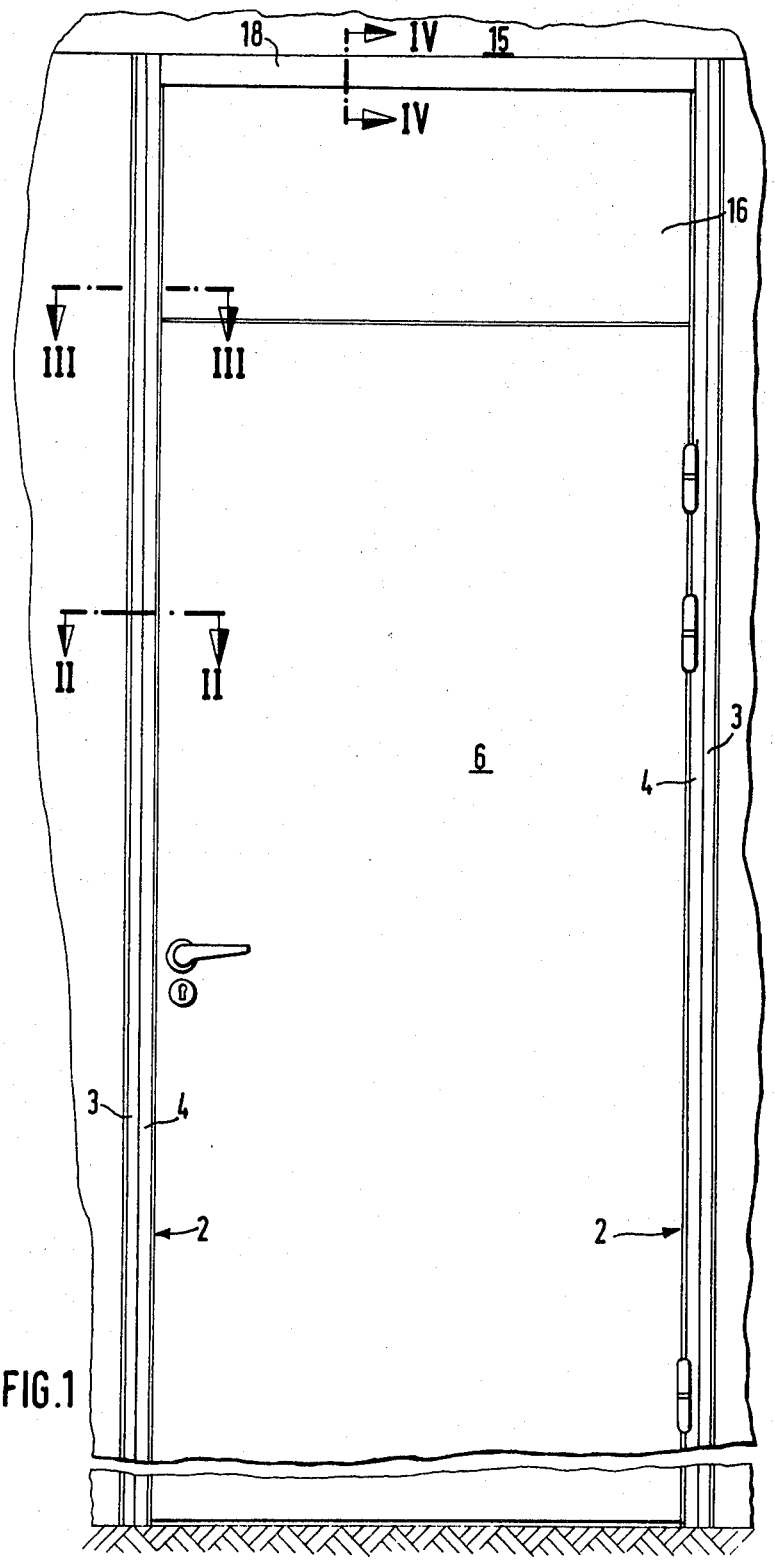
Figure 2:
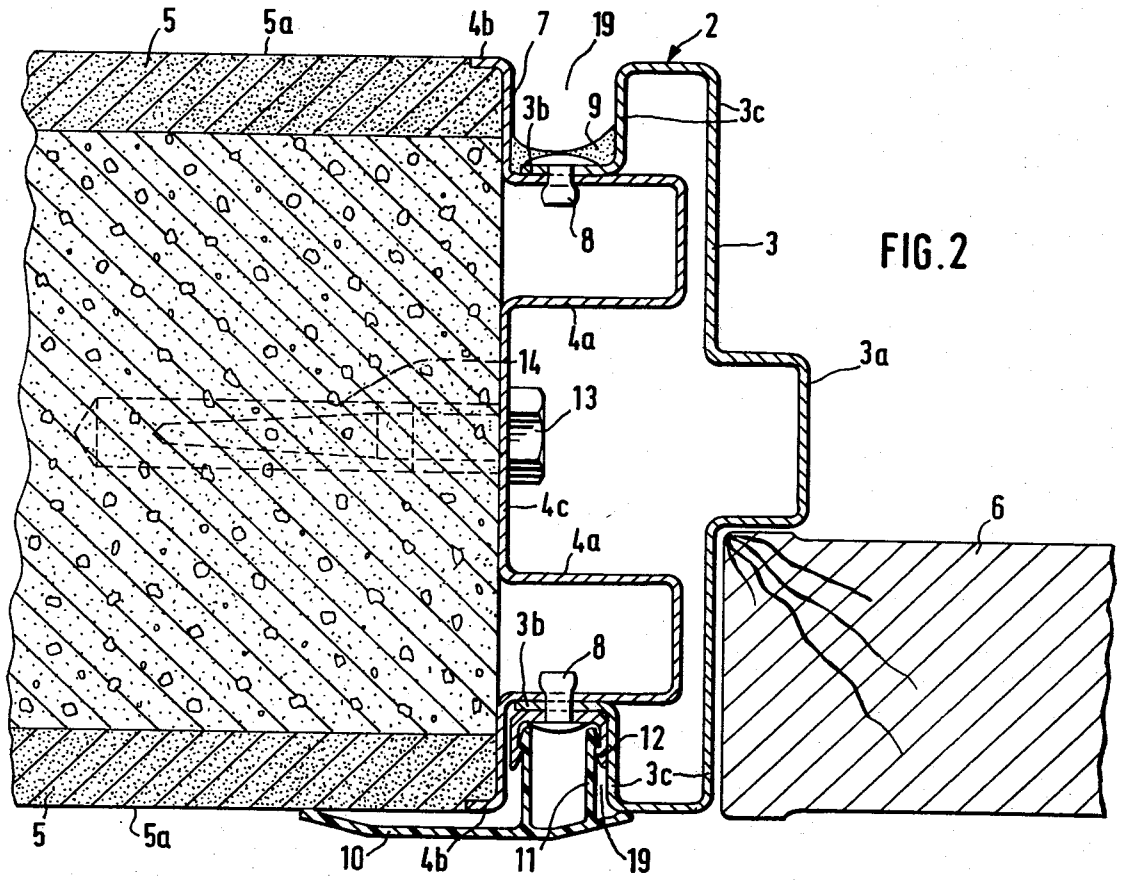
Figure 4:
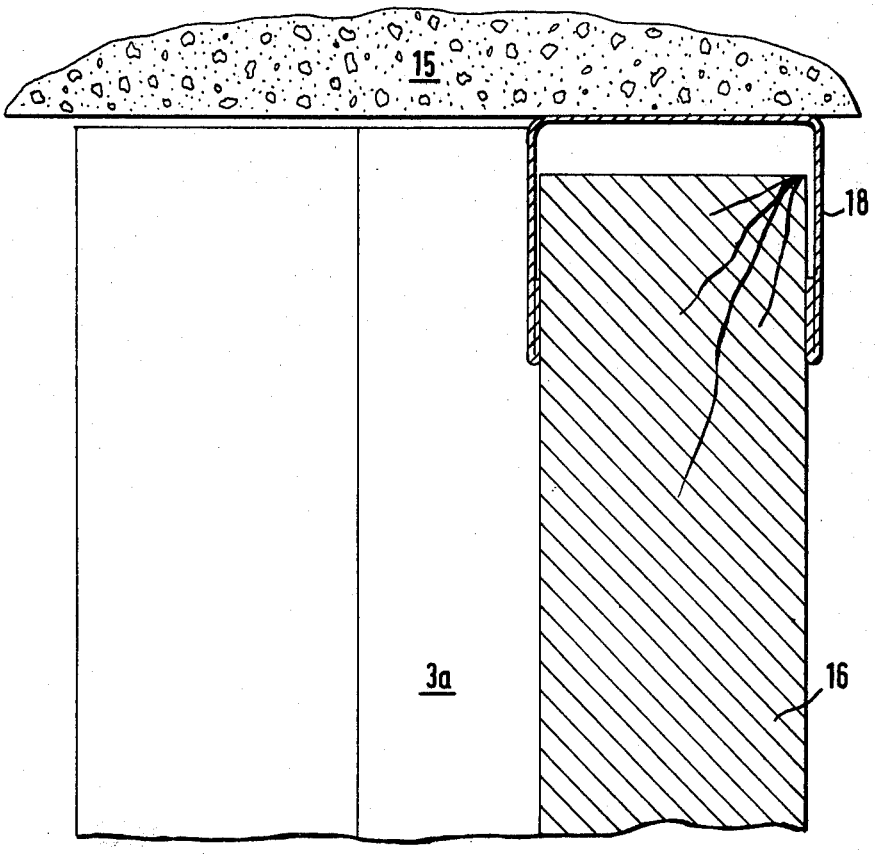
Figure 3:
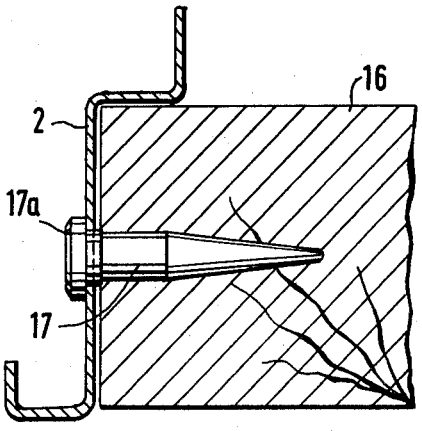

An embodiment of the invention shall now be described by way of example with reference to the accompanying drawings, in which, FIG. 1 is a front view of a door and a door frame according to the invention mounted in a wall, FIG. 2 is a section taken on the line II—II in FIG. 1 on a larger scale, FIG. 3 is a horizontal section taken on the line III—III in FIG. 1, and, FIG. 4 is a vertical section taken on the line IV—IV in FIG. 1.

The door frame shown in the drawings is mounted in a doorway in a wall 1 which may for instance consist of concrete. The door frame includes a pair of jambs 2. Each of the jambs 2 consists of two sheet metal sections 3 and 4. One of said sections 3 is arranged to accommodate the door leaf 6, while the other section 4 forms a mounting element which is attached to the wall, as best seen in FIG. 2, and which supports the other jamb portion 3. The sheet metal section 4 has a substantially flat middle portion **4*c* engaging the vertical face of the doorway in the wall 1. Moreover, the section 4 includes a pair of channel portions 4*a* each of which is connected to one of the longitudinal edges of the flat middle portion 4*c*. The section 4 also includes a pair of longitudinal edge portions 4*b* extending at right angles to the plane of the middle portion 4*c*, each of said flanges 4*b* being connected to the adjacent flank of the adjacent channel 4*a* by a flat portion 7 which is a co-planar with the middle portion 4*c*. In the embodiment shown, the distance between the edge portions 4*b* is equal to the thickness of the finished wall. Preferably the section 4 is mounted on the wall prior to the application of the final coat of plaster 5 on the wall 1, whereby the flange portion 4*b* will serve as a rule governing the thickness of application of the plaster. The middle portion 3*a* of the section 3 is shaped as a channel one flank of which serves to engage the door leaf 6. The section 3 is provided with a pair of flanges 3*b* the distance between which corresponds to the distance between the outer flanks of the channels 4*a* of the section 4. In the embodiment shown, each of the flanges 3*b* is connected to the main body of the section 3 through a channel portion 3*c*. The distance between the bottoms of said channels 3*c* is substantially equal to the distance between the flanges 4*b*. The space between each of the flat portions 7 and the adjacent flank of the channel 3*c* forms a vertical groove 19. Each of the outer flanks of the channels 4*a* is attached to the adjacent flange 3*b* of the section 3 by a plurality of vertically spaced rivets 8. As shown in the upper portion of FIG. 2, the heads of the rivets 8 may be covered by a filler composition 9 filling the bottom of the groove 19. As shown in the lower part of FIG. 2, the groove and the adjacent part of the wall 5 may be covered by a strip 10 provided with a spring catch 11 co-operating with a channel-shaped catch member 12 fastened in the groove 19 and provided with longitudinal projections. In order to allow adjustment of the position of the section 3 in relation to the section 4, the channels 4*a* of the section 4 may be provided with slots extending at right angles to the plane of the portion 4*c*, so that the section 3 can be mounted in the correct position with reference to the corresponding section 3 at the other edge of the doorway, irrespectively of the position of the section 4 of the jamb. Alternatively, the rivets may be fitted in holes which are bored first when the sections 3 and 4 have been adjusted to the correct position with reference to each other. The section 4 is attached to the wall by means of vertically spaced screws 13 each of which engages a sleeve 4 inserted in a bore in the concrete. The channel portions included in both of the sections 3 and 4 allow a certain adaptation of their width to the desired thickness of the wall. The space between the door leaf and the ceiling 15 is bridged by a stationary panel 16. Said panel 16 is attached below to the jamb sections 2 by means of a pair of pins 17 provided with a head 17*a* set at a space from the panel sufficient to accommodate the sheet metal of the section 2. To receive said pins the sections 2 are preferably provided with horizontal key hole slots allowing a free passage for the heads of the pins 17 to the position shown in FIG. 3 from one side of the jamb. The upper end of the panel 16 is retained by a channel section 18** attached to the ceiling.

The mounting of the door frame is preferably carried out in the following way. First, the sections 4 are attached to the sides of the doorway by means of the screws 13 or other suitable means, with due attention to the correct spacing of the flanges **4*b* from the wall. The plaster 5 is then applied to the level determined by the flanges 4*b*. It is as a rule preferable not to mount the sections 2 until the required painting, wall coating and carpet laying have been carried out. The sections 2 are cut to the required length, which is equal to the height of the doorway, and applied to the sections 4. Then, the channel section 18 for receiving the panel 16 is mounted in the upper end of the doorway. The upper edge of the panel 16 is inserted into the channel section 18 from below, and the panel is rotated about its upper edge into the position shown in FIG. 4, in which the pins 17 engage the slots provided in the sections 2 and the vertical edges of the panel 16 engage the channel portions 3*a*** of the sections 3. The sections 2 are then properly centered in the doorway by horizontal displacement in the plane of the wall whereupon the section 2 at the hinge side of the door is secured to the corresponding section 4, for instance by means of expanding rivets. When the door leaf has been mounted and the door play adjusted, the section 2 at the handle side of the door is also secured to the corresponding section 4. Finally the rivets are covered either by a filler compound or by means of a cover strip.

The invention is not limited to the example above described and shown in the drawings, but includes any arrangement within the scope of the appended claims.

What I claim is:

1. A door jamb comprising, a first sheet metal section having a flat portion for attachment to a vertical face of an aperture in a wall and a pair of channel-shaped portions on either side of said flat portion, an inner flank of one channel-shaped portion being connected by said flat portion to an inner flank of the other channel-shaped portion, a second sheet metal section for accommodating one edge of a door leaf, said second sheet metal section including a pair of longitudinal flange portions, each of which is slidably displaceable transversely of a respective one of the outer flanks of said channel-shaped portions, and means for fastening each of said longitudinal flange portions in a selected transverse position on the respective one of said outer flanks.

2. A door jamb as claimed in claim 1 which has a length exceeding the vertical length of the door leaf and which is provided with means for supporting a stationary panel fitted in the doorway above the door leaf.

3. A door jamb as claimed in claim 1 characterized in that said first sheet metal section comprises a pair of longitudinal edge portions extending at right angles to said flat portion, and a pair of flat portions substantially co-planar with said first-mentioned flat portion and connecting each of said edge portions with an outer flank of the adjacent channel-shaped portion.

4. A door jamb as claimed in claim 3 in which the second sheet metal section includes a pair of channel-shaped portions provided between said longitudinal flange portions and a middle portion of said second sheet metal section, the depth of said channel-shaped portions being substantially equal to the width of each of said pair of flat portions, whereby a groove is formed at either edge of the assembled door jamb between said flat portion and one flank of one of said last-mentioned channel-shaped portions.

5. A door jamb as claimed in claim 4 which includes a cover strip arranged to cover said groove and an adjacent edge portion of the wall.

6. A door jamb as claimed in claim 5 in which said cover strip is provided with a spring catch arranged to engage projections arranged in said groove.

* * * * *